United States Patent [19]

Williams

[11] 4,165,869

[45] Aug. 28, 1979

[54] T CLAMP

[76] Inventor: Curtis Williams, 321/200 Center Plz., Tulsa, Okla. 74119

[21] Appl. No.: 780,503

[22] Filed: Mar. 23, 1977

Related U.S. Application Data

[63] Continuation-in-part of Ser. No. 713,973, Aug. 12, 1976, abandoned, which is a continuation-in-part of Ser. No. 687,751, May 19, 1976, abandoned.

[51] Int. Cl.[2] ..... B25B 5/14

[52] U.S. Cl. ..... 269/41; 269/154; 269/155; 269/321 S

[58] Field of Search ..... 269/41, 42, 104, 110, 269/152–155, 321 S

[56] References Cited

U.S. PATENT DOCUMENTS

| | | | |
|---|---|---|---|
| 2,322,380 | 6/1943 | Mosley | 269/152 |
| 3,083,007 | 3/1963 | Campfield | 269/321 S |

FOREIGN PATENT DOCUMENTS

| | | | |
|---|---|---|---|
| 367613 | 2/1932 | United Kingdom | 269/155 |

*Primary Examiner*—Robert C. Watson
*Attorney, Agent, or Firm*—Mildred Flowers

[57] ABSTRACT

A clamp comprising a jaw assembly of three coacting work grippers connected to a plate provided with slots which guide the jaws so that they may be relatively arrayed and adjusted for various sizes of work pieces to be held at right angles for gluing or fastening; a left and right threaded actuating and locking screw for the two L-shaped jaws, and a separate identical screw for the third common jaw which they oppose; each jaw separately positionable manually; the two L-shaped jaws laterally in one slot set, the common rear jaw transversely in the same plane, back and forth, in three transverse slots in the plate; with shoulders to stabilize the lateral movement of the L-shaped jaws, and with a pilot mounted on rollers in the transverse slot to stabilize positioning of the rear jaw; provided with a pivoted eccentric cam in one model for the actuating and locking; and in another model a cam on end, pivoted with a hand lever with cam acting in a slot.

6 Claims, 7 Drawing Figures

T CLAMP

CROSS REFERENCES TO RELATED APPLICATIONS

This application is a continuation-in-part of co-pending application Ser. No. 713,973, filed Aug. 12, 1976, now abandon, and which is a continuation-in-part of application Ser. No. 687,751, filed May 19, 1976, now abandon.

BACKGROUND OF THE INVENTION

The invention in its several species is a novel embodiment of a clamp assembly comprising a plural actuating means, three jaws, plural jaw pairs, means to relatively array work holders, separate positioning means for each jaw, one jaw common to plural co-acting jaws, means for lateral adjustment of jaws, screw type means to lock and actuate jaws, with pivoted eccentric cam means to lock and actuate in one model, with a cam acting in a slot or groove, with a cam on end pivoted hand lever, with hand adjustment of right and left threaded screws.

DISCUSSION OF THE PRIOR ART

Reinhold Pat. Nos. 1,813,545, issued July, 1931, and 1,834,739, issued December 1932, are examples of presently available clamping devices. The inventive elements in each of these patents are analyzed below:

Reinhold's Device for Supporting Beams from Columns (1,813,545) was an admirably complex device for the purpose it was intended to serve: a temporary holder for steel beams and columns in building construction. The object of the present invention, however, is the provision of a lighter weight clamp for gluing and fastening in cabinet shops or for use by carpenters and welders in light joining operations.

If Reinhold's Device is the best citation from the relevant art, then the present invention must surely meet a great need since it solves several problems left unsolved by Reinhold's work. Among these problems are the protection of the surfaces of workpieces in industries where this is important; portability in small shops; and economy of production.

The I-Beam is also the object of Reinhold's Clip for Supporting Structural Members (1,834,739). In this device as in the Device for Supporting beams from Columns in the Construction of Welded Buildings, even the title belies the adaptability of the devices: they are highly specialized I BEAM DEVICES, and should be called I BEAM CONNECTORS.

Another problem of this art is the fact that large wrenches extraneous to the devices would be required. The kind of fastening done in this connection is not unlike permanent fastening. It is hardly to be called clamping: it is fastening, arduously and necessarily slowly accomplished.

BRIEF SUMMARY OF THE INVENTION

The present invention is a novel hand adjustable clamp which may be made of commercial steel and should be light enough to be conveniently placed over two 2×4's or other boards when the butt of one is to be joined to the face of another by gluing or fastening. Operation of the device is achieved by mounting it upon the work to be held and tightening two screws which draw three jaws together at the angles where the workpieces meet and at the back of the longitudinally placed workpiece. The novel support plate holds the jaw assembly in which two L-shaped jaws coact with a third common jaw. A cam and lever model for faster actuating and locking is comprehended and described.

It is an object of this invention to provide a single unitary support plate with guide slots for enabling the jaws of a jaw assembly to be separately positioned by hand and at once to be quickly actuated and locked as a jaw assembly.

Figure 1:
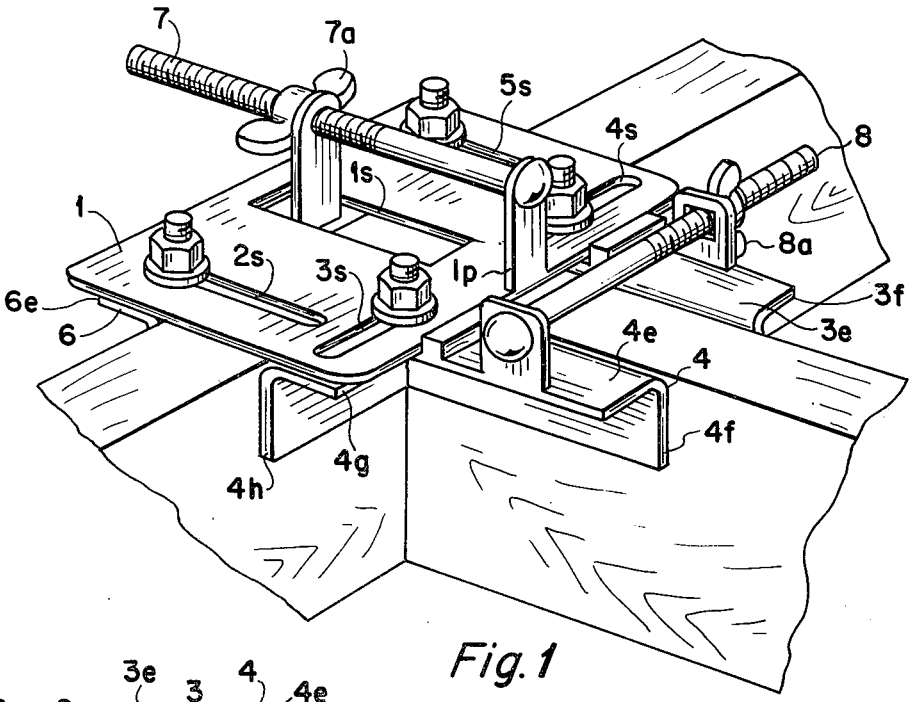
FIG. 1 is a perspective view of the assembled clamp.
Figure 2:
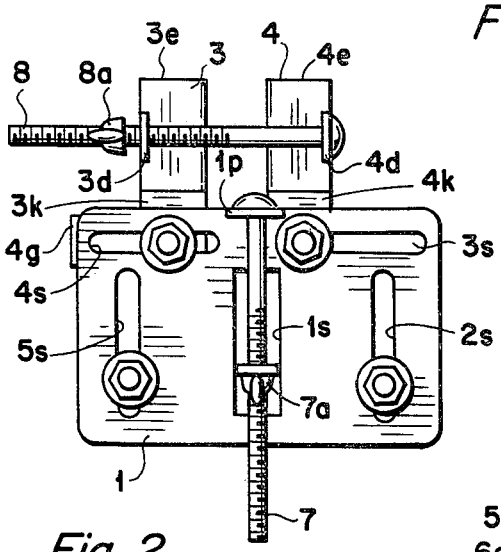
FIG. 2 is a top plan view of the assembled device.
Figure 3:
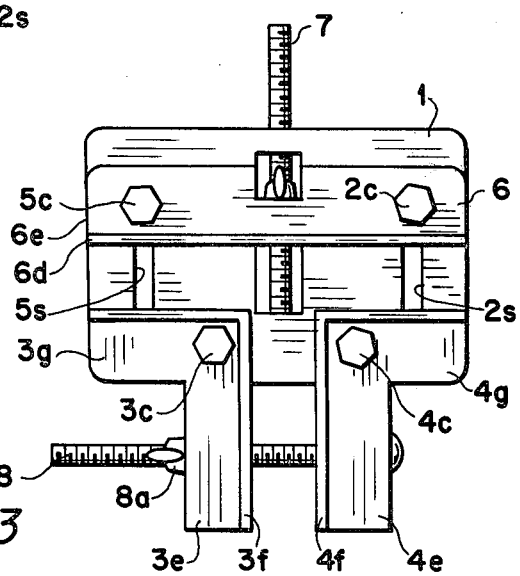
FIG. 3 is a bottom plan view of the assembled device.
Figure 5:
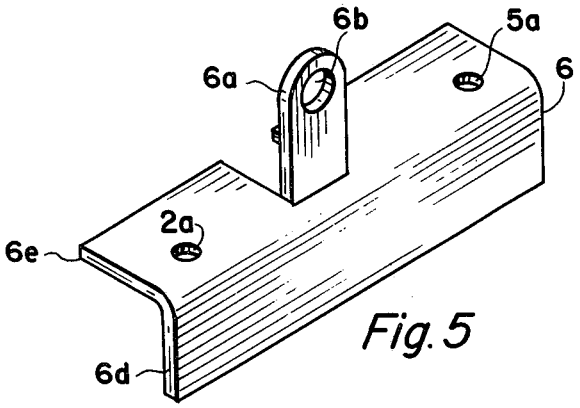
FIG. 5 is an isometric view of a rear jaw assembly element.
Figure 7:
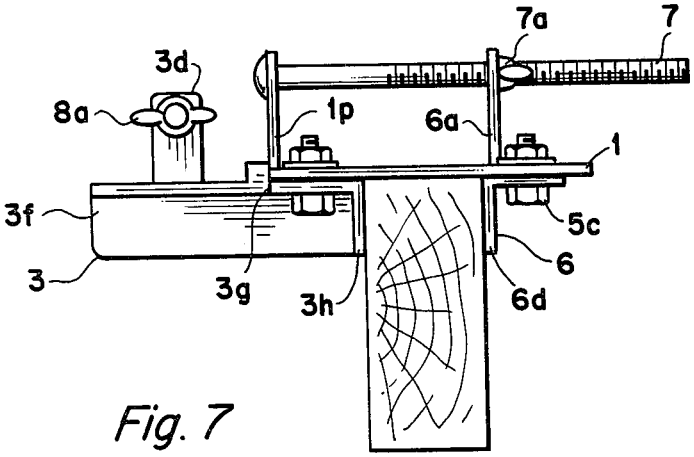
FIG. 7 is a side view in partial side elevation of the assembled device.

A clamp with a rectangular support plate, having an upper planar surface to the front long side F of which left L and right R, lengthwise and transverse, front and rear, horizontal and vertical are normal. Which support plate 1, hereinafter called the plate, has slots 1*s*, 2*s*, 3*s*, 4*s*, and 5*s* guiding the directions of three angle-iron jaw assembly elements 3,4,6 with vertical sides 3*f*, 4*f*, 3*h*, 4*h*, 6*d* beneath horizontal flanges 3*e*, 4*e*, 6*e* best seen in FIG. 3, in length equal to one-half the width of the plate 1, so arranged under the plate 1 that the lengthwise flanges 3*g*, 4*g* best shown in FIG. 3 face the bottom of the plate 1, and the transverse sides 3*f*, 4*f* oppose each other, the lengthwise sides 3*h*, 4*h* and flanges 3*g*, 4*g* extending away from the center of this opposition beneath and to the left and right edges respectively of the plate 1, so that these sides 3*h*, 4*h* oppose and are parallel to a rear jaw assembly element side 6*d*, the lengthwise jaw assembly element sides of all jaw assembly elements being nearer to the centers of opposition than their flanges. The flange of the rear jaw assembly element 6*e* best seen in FIG. 5 which has only one lengthwise side 6*d* and flange 6*e* equal in length to the plate 1, and which has no transverse side or flange, extends from the top of its side 6*d*, beneath and to the rear of plate 1, which has a central rectangular post slot 1*s*, hereinafter called the post slot in width a fourth the width of the plate 1, and in length three quarters the width of the plate 1, and situated nearer to the rear of the plate 1 than to its front F and in line with the centerline of a post 1*p* of width equal to that of the post slot 1*s*, and of a thickness equal to that of the plate 1, and extending upwardly from the front side F of the plate to a height one-fourth the width of the plate 1, containing near its upper end, a square hole 1*h* in which the square neck of a threaded bolt 7 is fitted and welded; which bolt extends transversely beyond the rear of the plate, horizontal to and above the centerline of the post slot 1*s*, passing through an unthreaded round hole 6*b* in a flat post 6*a* similar to the one at the front F of the plate 1, but longer by more than the thickness of the plate 1, and not so wide as the post slot 1*s* through which it must travel, driving with it the rear jaw assembly element 6 from the center of the top edge of whose side 6*d* it extends upwardly, driven by a wing nut 7*a* toward the front F of the plate 1. The rear jaw assembly element 6 is further supported and guided by unlocked fasteners 2*c*, 3*c*, 4*c*, and 5*c* in transverse fastener slots 2s,5s near the left L and the right R sides of the plate 1, passing vertically through holes 5a,2a near the left and right ends of the surface of the flange 6c of the rear jaw assembly element 6, directly beneath the transverse fastener slots 2s,5s.

The transverse length and locations of these slots are the same as that of the post slot 1s which they flank, allowing room for a non-tangent, lengthwise fastener slot 3s,4s between each of the transverse fastener slots 2s,5s and the front of the plate F.

Which two lengthwise fastener slots 3s,4s support the L-shaped jaw assembly elements 3,4 whose lengthwise flanges 3g,4g extend from the tops of their respective sides 3f, 4f to the front of the plate F, and whose sides 3f,4f,3h,4h are so oriented that one side of each is transverse, and one side of each is lengthwise.

These jaw elements are supported by unlocked fasteners 2c,3c,4c, and 5c riding in the lengthwise fastener slots 3s, 4s and fastened to the jaw assembly elements 3,4,6 at holes 2a,3a,4a,5a drilled at the centers of lines drawn from the outer to the inner vertices of the angles formed by the flanges 3e,3g,4e,4g.

Figure 4:
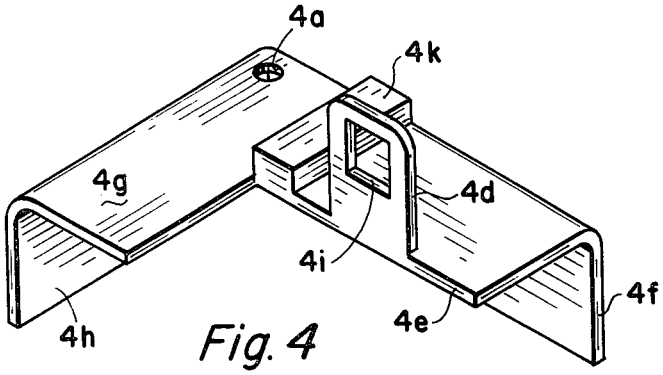
FIG. 4 is an isometric view of the left front jaw assembly element.
Figure 6:
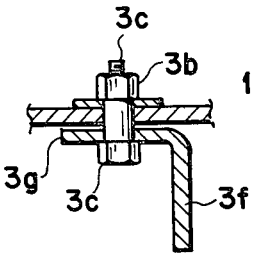
FIG. 6 is a fragmentary view showing the connection of a flange to the plate.

Which L-shaped jaw elements 3,4 have each a bolt post 3d,4d centrally and vertically placed along the left edge of the left transverse flange 4e and the right edge of the right, 3e, and extending upwardly to a height greater than the diameter of the head of a threaded bolt 8, the square neck of which is fitted and welded in a square hole 4i best seen in FIG. 4 nearer the upper extremity of the left hand post 4d which bolt 8 passes through and beyond a round hole 3i in the right hand post. The centerlines of these holes are equidistant from the tops of the flanges 3e,4e.

A wing nut 8a activates this jaw set, and the two wing nuts of the apparatus 7a,8a activate the jaw assembly in such manner that the two L-shaped jaw assembly elements 3,4 oppose each other as well as the rear jaw assembly element 6, enabling the jaw assembly to hold boards and studs beneath the plate at right angles to each other for gluing and fastening.

Shoulders 3k and 4k best shown in FIG. 4 are provided on flanges 3e and 4e abutting the front edge of plate 1 to prevent pivoting of the jaw assembly elements 3 and 4 in holes 3a and 4a and to assure stable side to side sliding of the jaw assembly elements in slots 3s,4s.

I claim as my invention:

1. A clamp assembly comprising first clamp means removably receiving a first work piece therein, second clamp means movable in directions toward and away from said first clamp means and cooperating therewith for receiving a second work piece therein and securely retaining the second work piece in engagement with said first work piece, a single uninterrupted workpiece engaging flange member provided on said first clamp means for receiving one side of said first work piece thereagainst, a pair of oppositely disposed spaced substantially L-shaped flange members provided on said second clamp means and movable in directions toward and away from each other for securely clamping said second work piece therebetween and in said second clamp means, first adjustment means operably connected between said first and second clamp means for controlling the pressure engagement of both clamp means against the opposite sides of the first work piece, and second adjustment means operably connected between the spaced L-shaped flange members for controlling the clamping pressure against the opposite sides of the second work piece for securely retaining one end of the second work piece in engagement with one side of the first work piece during a clamping operation.

2. A clamp assembly as set forth in claim 1 wherein said second clamp means comprises support plate means having first aperture means provided therein, said oppositely disposed L-shaped flanges slidably secured in said aperture means and movable in alternate directions toward and away from each other, bracket means provided on each L-shaped flange for receiving the second adjustable means therethrough for providing said alternate movement for said L-shaped flanges.

3. A clamp assembly as set forth in claim 2 wherein the support plate means includes second aperture means disposed substantially perpendicularly with respect to said first aperture means, and said first clamp means comprises said single flange member slidably secured to said second aperture means and movable in alternate directions toward and away from said L-shaped flanges, bracket means provided on said support plate disposed in substantial alignment with the last mentioned bracket means whereby said first adjustment means extends through said aligned bracket means whereby said single flange member may be moved alternately toward and away from said L-shaped flanges for controlling the clamping pressure on the first work piece.

4. A clamp assembly as set forth in claim 3 wherein the aligned bracket means each extend in a direction away from the L-shaped flanges.

5. A clamp assembly as set forth in claim 3 wherein at least one clamp means is provided with guide means for facilitating the movement of said clamp means.

6. A T-clamp for simultaneously clamping first and second workpieces in an engaging relationship and which comprises a substantially flat support plate, an angle bracket slidably mounted on said support plate for reciprocal movement along one axis thereof for providing a surface perpendicular to the plane of said support plate, a first L-shaped angle bracket fixed to said support plate providing a pair of surfaces perpendicular to the plane of a support plate and perpendicular to each other, one of said surfaces being oriented parallel to the surface of the slidable angle bracket, a second L-shaped angle bracket slidably mounted on said support plate for reciprocal movement along an axis perpendicular to the axis of travel for the slidable angle bracket for providing a pair of surfaces perpendicular to the plane of the support plate and perpendicular to each other, one of said surfaces oriented in a coplanar relationship with the surface of the first L-shaped angle bracket which is oriented parallel to the surface of the slidable angle bracket, means for urging the second L-shaped angle bracket against the first work piece between the first and second L-shaped angle brackets, and means for urging the slidable angle bracket against the second work piece between the slidable angle bracket and the first and second L-shaped members.

* * * * *